US006302712B1

(12) United States Patent
Delsole

(10) Patent No.: US 6,302,712 B1
(45) Date of Patent: Oct. 16, 2001

(54) SPARK PLUG WIRE BOOT SECURING SYSTEM

(76) Inventor: Robert J. Delsole, 87 Valley Rd., Larchmont, NY (US) 10538

( * ) Notice: Subject to any disclaimer, the term of this patent is extended or adjusted under 35 U.S.C. 154(b) by 0 days.

(21) Appl. No.: 09/354,752

(22) Filed: Jul. 29, 1999

Related U.S. Application Data

(63) Continuation-in-part of application No. 08/918,046, filed on Aug. 25, 1997, now abandoned.

(51) Int. Cl.[7] ..... H01R 13/44
(52) U.S. Cl. ..... 439/125
(58) Field of Search ..... 439/125–128, 439/371; 123/169 PA, 169 PH

(56) References Cited

U.S. PATENT DOCUMENTS 1,245,931 * 11/1917 Lanman .
1,928,520 * 9/1933 Werner .
3,193,615 * 7/1965 Burrows .
4,701,662 * 10/1987 Yamanashi et al. ..... 439/125
4,906,202 * 3/1990 Germ ..... 439/127
5,188,537 * 2/1993 Itoh et al. ..... 439/127
5,344,328 * 9/1994 Suggs ..... 439/127

* cited by examiner

*Primary Examiner*—Gary F. Paumen
(74) *Attorney, Agent, or Firm*—Richard A. Joel, esq.

(57) ABSTRACT

An automotive spark plug ignition wire conduit having an insulating terminal cap of a flexible, compressible moisture proof insulating material of a generally annular cross-section, a first open end for receiving an insulated electrical ignited wire, a second open end adapted to be placed over a spark plug wire terminal and retained thereon, wherein the cap has an annular recess formed in the external surface of the cap, and a groove adapted to receive a fastening strap to be tightened about the cap and retained in the recess. In an alternate embodiment, a cap includes molded internal grooves having a spring wire molded therein gripping a spark plug.

The device keeps ignition wires from becoming disconnected due to engine and road vibrations. It is especially useful in racing environments.

5 Claims, 4 Drawing Sheets

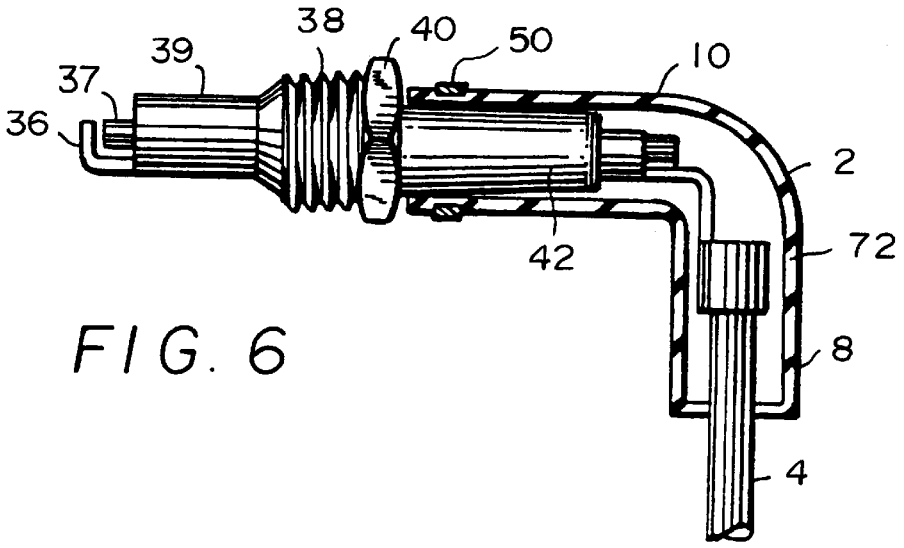
FIG. 6
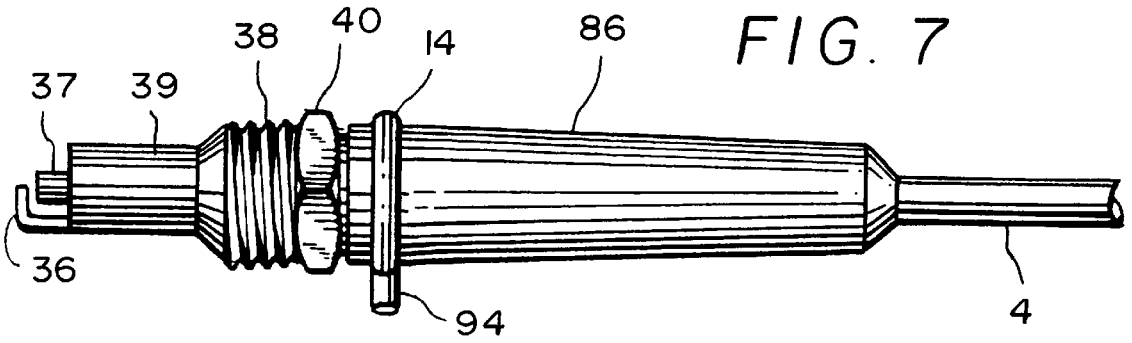
FIG. 7
FIG. 8
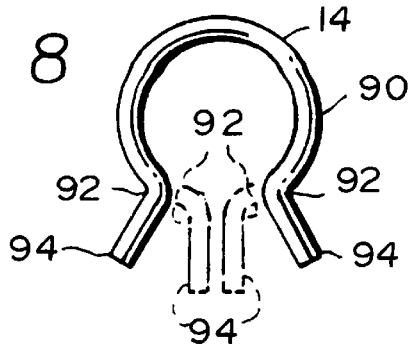

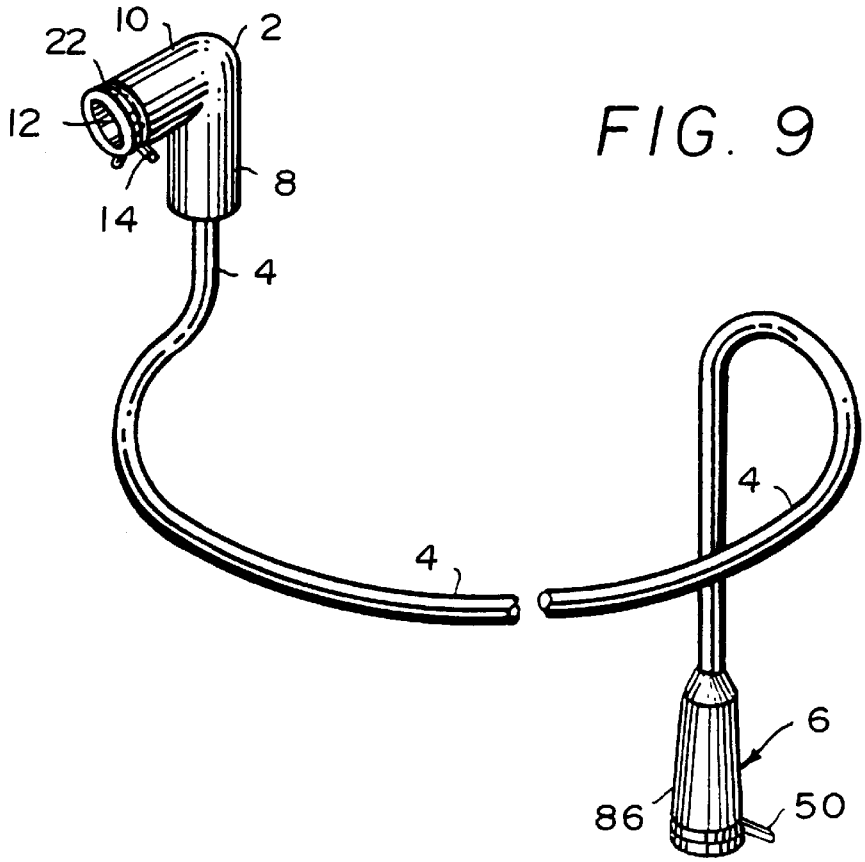
FIG. 9
FIG. 10
PRIOR ART
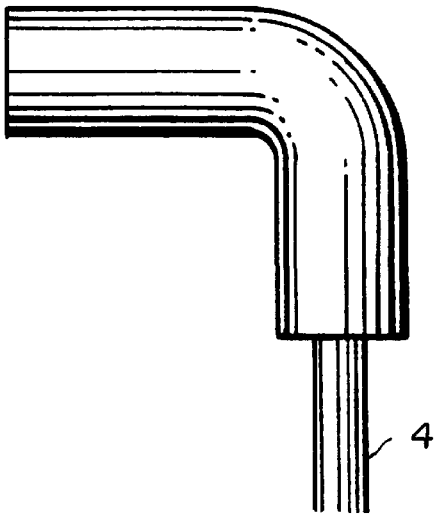
FIG. 11
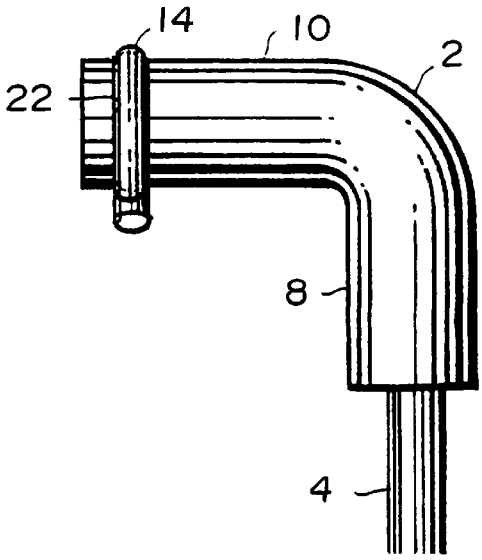

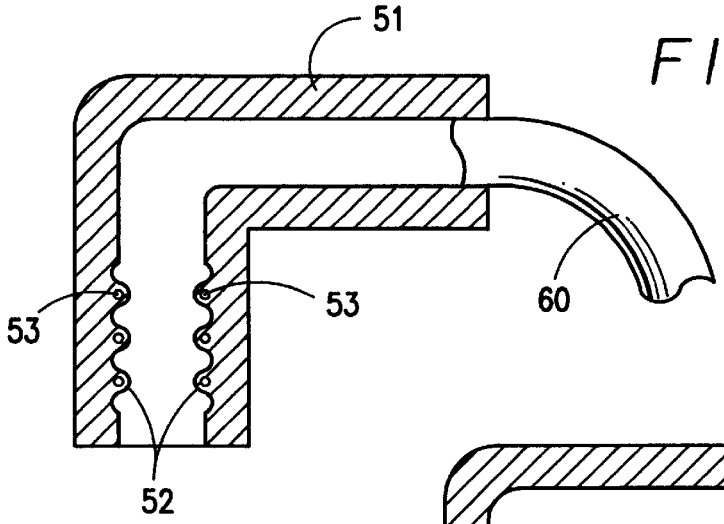
FIG. 12
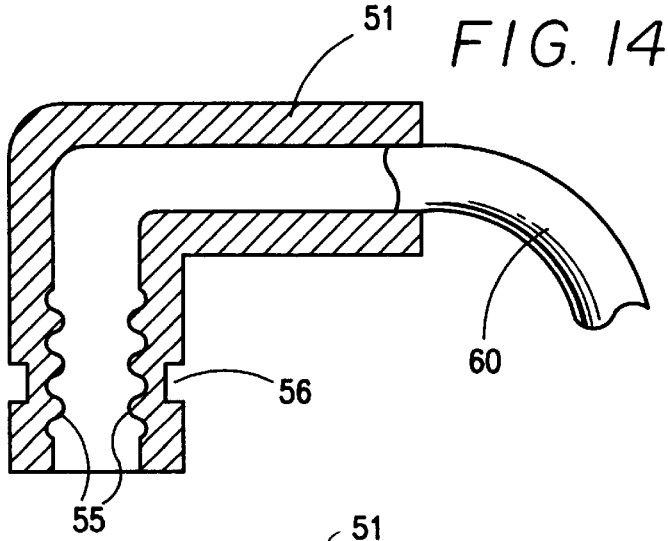
FIG. 14
FIG. 15
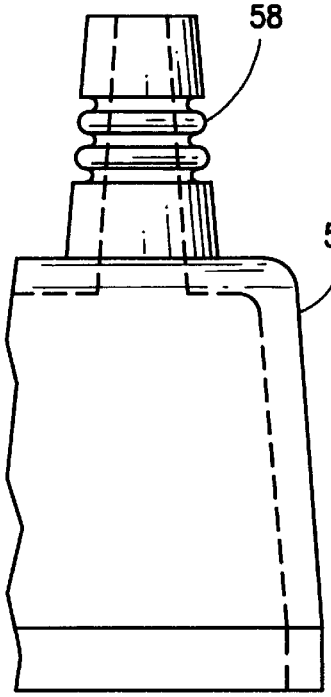
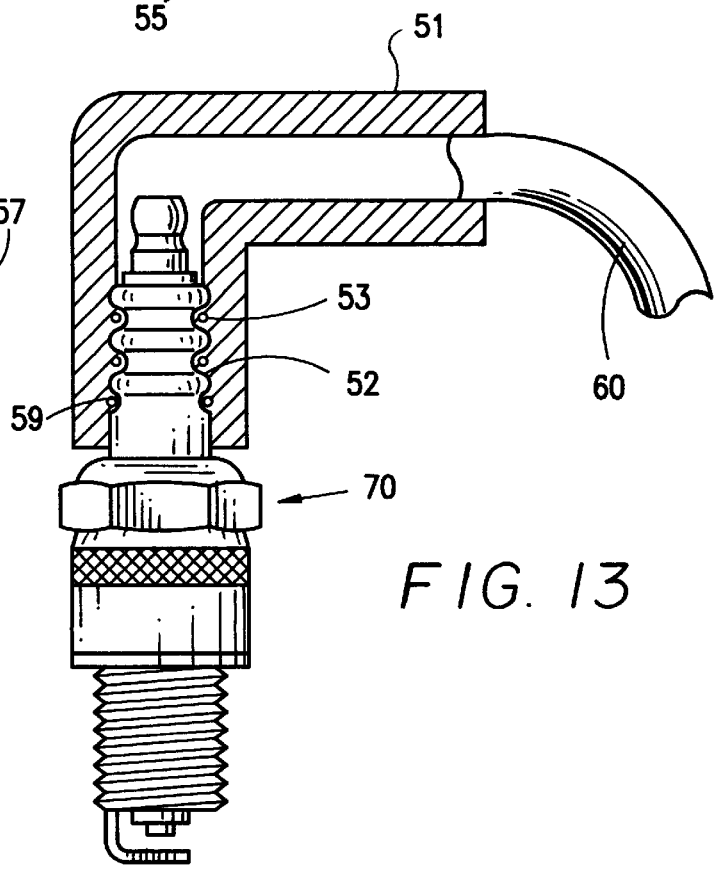
FIG. 13

SPARK PLUG WIRE BOOT SECURING SYSTEM

CROSS-REFERENCE TO RELATED APPLICATIONS

This application is a continuation in part of Ser. No. 08/918,046, filed Aug. 25, 1997 now abandoned.

STATEMENT REGARDING FEDERALLY SPONSORED RESEARCH OR DEVELOPMENT

NOT APPLICABLE

BACKGROUND OF THE INVENTION

FIELD OF THE INVENTION

This invention relates to a means for securing the waterproof caps or boots of ignition wires to spark plugs, the distributor cap and/or coil on internal combustion engines

DESCRIPTION OF THE RELATED ART INCLUDING INFORMATION DISCLOSED UNDER 37 CFR §§1.97–1.98

The boot or cap of the present invention is suitable for securing distributor wires and spark plug connections on internal combustion engines. The purpose is to provide a cap or boot wire connection which fits securely and tightly around the wiring and spark plug connector in order to prevents moisture from creeping into electric connection and especially to prevent the wire from vibrating off the plug during travel over rough roads at high speeds typically encountered in the racing car environment. The present invention is particularly useful in racing cars, because the vibration and heat etc. involved in the high performance runs of such vehicles often cause a spark plug wire to either come completely off the ends of the spark plug and cause missing and loss of power in the engine or to become partially loose and cause a breakdown in the conductivity and degradation of the spark and consequent loss of power and an increase in vehicle emissions. Another area in which the improvement is of great value is marine engine applications.

Various remedies have been sought for this condition and generally include elaborate connecting means involving snaps, bolted to secure the wire. Such designs are time consuming as well as adding measurable weight to a car which is particularly critical in racing environments.

Where time is at an extreme premium during pit stops in a race, it is essential that any service such as changing of spark plugs necessary during the pit stop be effectuated in the minimum amount of time. Therefore, any complicated mechanical additions to the spark plug and /or wiring are unsuitable. It is essential, however, that the proper spark be assured continuously and this requires limiting the number of disconnects in the wiring harness.

The closest prior art references of which the applicant is aware are as follows:

At the present there is no suitable device available. The closest art reference from a general structural point of view is U.S. Pat. No. 3,193,615 to Burrows, disclosing a waterproof cap with an integral O-ring which serves primarily as a moisture seal, as opposed to a securing ring to prevent the cap from slipping off the end of the plug.

U.S. Pat. No. 5,344,328 to Suggs discloses a spark plug keeper which essentially has a ring shaped base which fits under the lower portion of the spark plug hex nut and bears against the underside of the hex nut to support a binding strap which straps around the upper end of the plug on the exterior of the boot. The interior of the boot is provided with internal flexible barbs to assist in holding the boot and maintaining it in electrical engagement with the spark plug.

Another relevant patent is Australian 146,131 which requires a special type spark plug with a machined groove to accept a flange on the boot. The Australian boot seals the entire spark plug which permits the transfer of heat directly to the boot leading to premature failure.

U.S. Pat. No. 1,245,931 to Lanman shows a spark plug protector or boot which is provided with screw adjustable rings on the plug-end lead as well as the wire-end lead that are screwed tightly to help secure the plug.

References that are for background interest only are:

U.S. Pat. No. 5,127,840 to Bezusko, et al: SPARK PLUG CONNECTOR

U.S. Pat. No. 5,188,537 to Itoh: FOR A SLIPPAGE PREVENTOR AND IGNITION TERMINAL CABLE U.S. Pat. No. 1,928,520 to Weriner: FOR SHROUDING CAP FOR SPARKING PLUGS None of these references show a simple, effective way for assuring the secure attachment of the spark plug shroud or wire cap to the spark plug electrode as contrasted with Applicaut's design. The device of this invention which may be readily utilized, is simple in structure, and low in cost. Furthermore, this unique design can be used on modern type engines where the spark plug is recessed into or below the surface of the cylinder head. The new recessed engine designs are responsible for much of the increased fuel mileage and improved performance of today's vehicles. The cited references cannot be used with these modern head configurations since they physically will not fit or there is no room to manipulate their securing procedure.

The present invention provides positive control to prevent the wire boot cap from coming off the end of the plug because the tie or bracket utilized secures the structure to that of the hub of the spark plug.

SUMMARY OF THE INVENTION

The present invention provides an improved rubber insulator cover for spark plug lead wires including a means of connecting the caps and the wire securely to the end of the spark plug in such a maimer as to prevent the unwanted disconnection of the wire lead from the spark plug outer electrode.

This is achieved by providing an annular groove in the portion of the rubber cap which fits over the end of the spark plug at the depth equal to that of a spring biased constrictor which is fitted into the (groove and compresses the cover against the knob of the plug in such a way that the constrictor goes below the shoulder of the ridge on the connector and holds the cap material tightly therein making it impossible for the cap to slip off inadvertently due to heat, vibration and the like. This is particularly important during racing conditions where any loss of power due to lack of conductivity or continuity of the electrical distribution system is very critical. The tie is a spring-loaded clip, or wire twist tie, or the equivalent thereof.

The device of this invention is designed for use on conventional spark plugs consisting of the spark electrode, threaded base, insulated porcelain cover parts and the threaded electrode contact at the end of which the distributor wire is usually fitted to the connection in a simple friction or spring fitted connection and consequently it is subject to loosening and disconnection due to engine and road vibration.

The boot covers the electrode lead wire and at a point corresponding to where it fits to over the head of the plug has specially formed, generally angular groove in the boot designed so to receive a tie or spring ring to tightly compress the boot cover and wire against the angular recess in the porcelain insulator of the plug making it physically impossible for the wire to become disconnected from the plug electrode.

The tie which is placed in the recess groove can be either a twist wire, a plastic wire or pipe/wire hanger of other type wherein the one end is pulled through a slot, and grooved teeth are secured or a typical omega clamp which is spring biased to the clamp position, but may be forced on across the diameter of the gap and snapped into place. Such clamps are known for utility and connection rubber conduits and the like in the plumbing industry.

An alternate embodiment of the invention comprises a boot including molded internal. grooves and steel spring clips molded within the grooves to exert a clamping force on the spark plug. The boot can also include molded internal grooves combined with an outer recess used with an external wire tie.

Accordingly, an object of this invention is to provide a new and improved terminal cap for connecting the ignition wire to a spark plug or distributor cap in internal combustion engines.

Another object of this invention is to provide a new and improved terminal cap which securely fastens to a spark plug or distributor cap.

A more specific object of this invention is to provide a new and improved terminal cap for spark plugs which includes a plurality of molded grooves with spring wires positioned therein to engage a spark plug in a firm connection.

BRIEF DESCRIPTION OF THE DRAWINGS

The above and other objects and advantages of this invention may be more clearly see when viewed in conjunction with the accompanying drawings wherein:

FIG. 6 is a side view partially in section of the plug wire cover cap of FIGS. 1 and 3;

FIG. 7 is a side view of an alternative cap tie or clip to that shown on the cap in FIGS. 2 and 4;

FIG. 8 is a plan view, partially in phantom shown an alternative retainer clip for use with either of the wire covers;

FIG. 9 is an overall perspective view of a spark plug wire with a spark plug cover cap at one end and a distributor connection cap at the other end;

FIG. 10 is a side view of a prior art type of plug wire cover connector;

FIG. 11 is a side view of a plug cover and clip according to the present invention;

FIG. 12 is a side cross-sectional view of a boot with molded grooves and spring clips;

FIG. 13 is a side cross-sectional view of the boot of FIG. 12 assembled to a spark plug;

FIG. 14 is a side cross-sectional view of a boot with molded grooves and an external recess for wire ties; and, FIG. 15 is an ignition coil tower or distributor cap terminal with molded external grooves for cooperation with the ignition wire boot grooves.

DETAILED DESCRIPTION OF THE INVENTION

Figure 1:
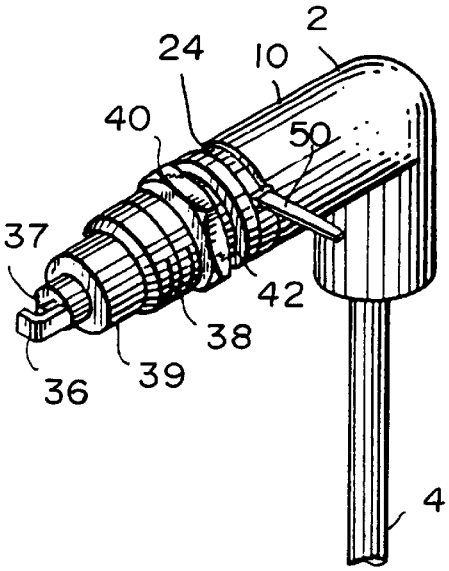
FIG. 1 is a perspective view of a spark plug wire and cap with the retainer strap according to the present invention.
Figure 2:
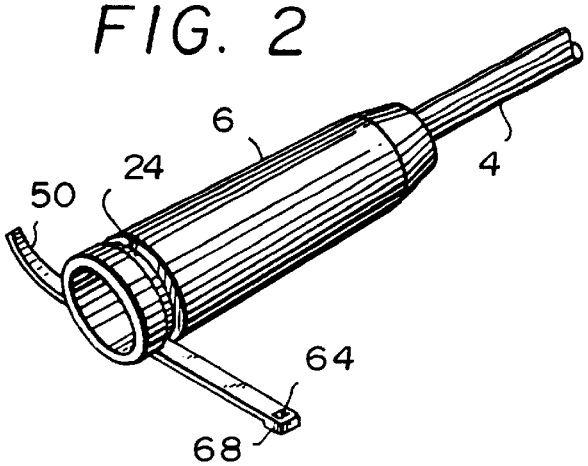
FIG. 2 is a perspective view showing a distributor wire cap with a tie retainer strap according to the present invention being placed thereon.
Figure 3:
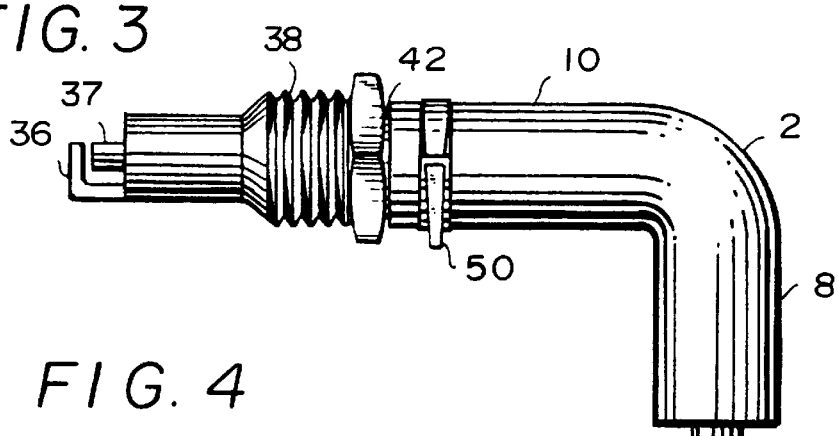
FIG. 3 is a side plan view of the strap of the cap according to the present invention.

Referring now to the drawings, the invention as shown in FIG. 1 shows a perspective overall view of the device of the present invention in place on a spark plug and showing the clip retaining end device.

The plug and distributor wire cap cover according to the present invention is shown the overall view of FIG. 1 and comprises the spark plug cover 2 comprised of a hollow rubber shell having the standard descending base and a horizontally extending plug cover portion 10 with the annular opening 12 formed in the end thereof and an annular recessed groove 24 formed in the outer end of the plug section together with a spring biased closure clip 14 thereon. The other end of the plug wire 4 leads to the distributor plug cap 6 having recessed groove 24 therein with a retainer clip 50.

Figure 4:
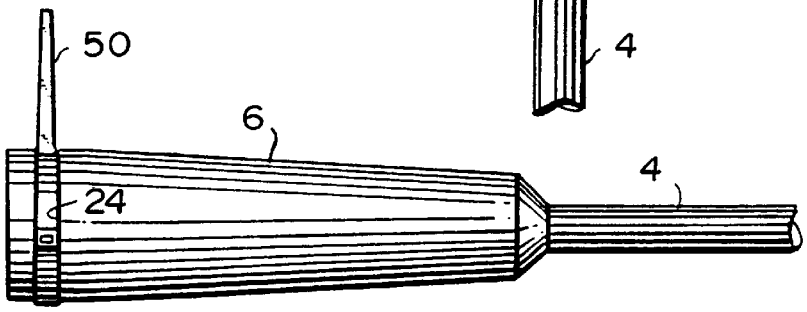
FIG. 4 is a side plan view of the restraining strap in place of the distributor wire cap.
Figure 5:
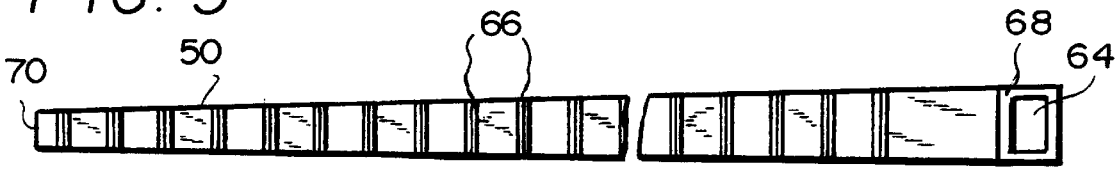
FIG. 5 is a plan view of the strap on the cover of FIGS. 1–4, and 6.

The covers 2 and 6 are generally dimensioned consistent with the usual standard types employed and can be fabricated of any of the usual rubber/plastic compositions currently employed or more advanced materials such as silicon. The cover 2 fits over the usual spark plug shown in FIG. 1 and in the normal manner. The plug includes a hexagonal portion 40, porcelain insulator 42, the usual threaded portion 38, extension 39, and electrode 36 and 37 as shown in FIGS. 1, 3, 5 and 7. Referring to FIGS. 4 and 7, an analogous distributor cap cover 6 has a strap 50 in the groove 24. The strap 50 has tapered end 70 remote from the end 68 with the aperture 64 provide therein. Barbs 66, which as the end 70 is slipped through the aperture 64 rest on the edges of aperture 64 so that the strap 50 may be tightened in one direction only. in order to get it (50) off, the strap 50 must be maneuvered roughly or cut off.

An alternative device is shown in FIG. 8 where a clip 14 is utilized as the tie and includes annular portion 90 which terminates at 92 and then end portion 94 flare outwardly.

The use of the clip 14 is shown in FIG. 7.

The cap covers 2 and 6 generally have a quarter-inch wide by an eighth to a quarter inch deep annular groove adjacent to the end thereof which covers the plug or goes onto the distributor head knob and easily guides the strap or the retaining clip into place which is then tightened.

This combination serves to clearly and assuredly prevent the wire lead from falling off the end of the electrode of the plug or from becoming disconnected from the distributor leads during the high vibrations particularly encountered in a racing environment.

The straps 14 and 50 on the wire caps 10 and 6 can be removed from the spark plug and the distributor contacts rapidly by nipping with pliers or compressing and the like.

An alternate embodiment of the invention is shown in FIG. 12 and FIG. 13 discloses the invention assembled to a conventional spark plug 50. A boot 51 includes molded internal grooves 52 and steel spring clips 53 molded within the grooves 52 which exert a clamping force about the spark plug 50. FIG. 14 shows a similar boot 51 with molded grooves 55 and an external circumferential recess 56 for a wire tie or clip (not shown). The boot 51 is shaped at a predetermined angle which is generally 90° but could vary in particular engine designs.

FIG. 15 shows an ignition coil tower or distributor cap terminal 57 with molded grooves 58 on the external portion to correspond to the ignition wire boot grooves. FIG. 14 shows the boot attached to a spark plug 50 but the boot 51 or 54 could also be attached to the distributor cap terminal 57.

While the invention has been explained by a detailed description of certain specific embodiments, it is understood that various modifications and substitutions can be made in any of them within the scope of the appended claims which are intended also to include equivalents of such embodiments.

What is claimed, is:

1. An automotive spark plug ignition wire conduit insulated terminal cap for connection to a mating terminal on a spark plug or distributer cap comprising:

a flexible hollow compressible moisture proof insulating body portion a first open end for receiving an insulated electrical ignition wire, a second open end adapted to be placed over a terminal and retained thereon, said cap having an annular recess formed in the external surface of said cap and a fastening strap and wherein said recess is adapted to receive the fastening strap for tightening about said cap to retain the cap on the terminal.

2. A combination as claimed in claim 1 wherein the strap is comprised of plastic.

3. A combination as claimed in claim 1 wherein the strap is comprised of metal.

4. An automotive spark plug ignition wire conduit insulated terminal cap for connection to a mating terminal on a spark plug or distributor cap in accordance with claim 1 wherein;

the second open end includes a plurality of integrally molded internal grooves to engage the terminal and the external annular recess is located adjacent to the grooves; and, wherein the fastening strap is mounted in the recess to securely grip the tenninal.

5. An automotive spark plug ignition wire conduit insulated terminal cap for connection to a mating terminal on a spark plug or distributor cap comprising:

a flexible, hollow, compressible moisture proof insulating body portion, a first open end for receiving an insulated electrical ignition wire, a second open end adapted to be placed over a terminal and retained thereon; and, wherein the cap curves at approximately 90° angle at an intermediate point thereof and the second open end is located at an angle to the first open end and includes a plurality of molded internal grooves to engage the terminal, said grooves having a spring clip molded thereabout to provide a gripping action on the terminal.

* * * * *